US009192951B2

(12) United States Patent
Hopper

(10) Patent No.: US 9,192,951 B2
(45) Date of Patent: Nov. 24, 2015

(54) SPRAY GUN

(75) Inventor: Timothy George Hopper, Guildford (GB)

(73) Assignee: Wagner Spraytech (UK) Limited, Guildford, Surry (GB)

( * ) Notice: Subject to any disclaimer, the term of this patent is extended or adjusted under 35 U.S.C. 154(b) by 306 days.

(21) Appl. No.: 13/470,433

(22) Filed: May 14, 2012

(65) Prior Publication Data

US 2012/0318890 A1 Dec. 20, 2012

(30) Foreign Application Priority Data

Jun. 17, 2011 (GB) ..... 1110336.3
Sep. 2, 2011 (GB) ..... 1115249.3

(51) Int. Cl.

| | |
|---|---|
| ***B05B 1/28*** | (2006.01) |
| ***B05B 7/08*** | (2006.01) |
| ***B05B 7/00*** | (2006.01) |
| ***B05B 7/04*** | (2006.01) |
| ***B05B 7/02*** | (2006.01) |
| ***B05B 1/12*** | (2006.01) |
| ***B05B 1/16*** | (2006.01) |
| ***B05B 15/06*** | (2006.01) |
| ***B05B 9/01*** | (2006.01) |
| ***B65D 83/14*** | (2006.01) |
| ***B05B 7/24*** | (2006.01) |

(52) U.S. Cl.

CPC ..... *B05B 7/0823* (2013.01); *B05B 1/12* (2013.01); *B05B 1/1645* (2013.01); *B05B 7/0081* (2013.01); *B05B 7/025* (2013.01); *B05B 7/0475* (2013.01); *B05B 7/083* (2013.01); *B05B 7/0815* (2013.01); *B05B 7/2432* (2013.01); *B05B 9/01* (2013.01); *B05B 15/065* (2013.01); *B65D 83/7532* (2013.01)

(58) Field of Classification Search

USPC ..... 239/296, 297, 299–301, 390, 392, 394, 239/396–397, 437, 439, 442, 525, 526

See application file for complete search history.

(56) References Cited

U.S. PATENT DOCUMENTS

| | | | | | |
|---|---|---|---|---|---|
| 1,627,117 | A | * | 5/1927 | Preble et al. | 239/297 |
| 3,843,052 | A | | 10/1974 | Cowan et al. | |
| 4,386,739 | A | | 6/1983 | Kwok | |
| 4,948,053 | A | * | 8/1990 | Hufgard | 239/301 |
| 5,135,172 | A | * | 8/1992 | Toth | 239/297 |
| 5,141,161 | A | | 8/1992 | Anderson et al. | |
| 5,190,219 | A | * | 3/1993 | Copp, Jr. | 239/296 |
| 5,217,168 | A | * | 6/1993 | Svendsen | 239/297 |

(Continued)

FOREIGN PATENT DOCUMENTS

| | | |
|---|---|---|
| DE | 102009053449 A1 | 2/2011 |
| DE | 202010007355 U1 | 10/2011 |

(Continued)

*Primary Examiner* — Steven J Ganey

(74) *Attorney, Agent, or Firm* — Burr & Brown, PLLC

(57) ABSTRACT

An air spray gun is described which is operated by blowing air past a nozzle, the air drawing the spray liquid from the nozzle and imparting momentum to it. The air cap includes formations to bias air flow towards the air horns having patterning air directed to them. The central opening extends towards the air horns, either in the form of a square opening with the corners of the square closest to the horns, or in the form of a compound curved shaped providing pronounced curvature of the corners at the axes toward the horns. This significantly improves paint spray patterning and discourages paint deposition on the air horns.

18 Claims, 11 Drawing Sheets

(56) References Cited

U.S. PATENT DOCUMENTS

| | | | | |
|---|---|---|---|---|
| 5,279,461 | A * | 1/1994 | Darroch | 239/297 |
| 6,230,986 | B1 * | 5/2001 | Vacher et al. | 239/297 |
| 6,494,387 | B1 * | 12/2002 | Kaneko | 239/296 |
| 6,776,360 | B2 | 8/2004 | Haruch et al. | |
| 6,824,071 | B1 * | 11/2004 | McMichael | 239/8 |
| 7,201,336 | B2 * | 4/2007 | Blette et al. | 239/601 |
| 2004/0035952 | A1 * | 2/2004 | Gerstner | 239/433 |
| 2004/0046040 | A1 | 3/2004 | Micheli | |
| 2007/0262171 | A1 * | 11/2007 | Wong | 239/296 |
| 2008/0295768 | A1 | 12/2008 | Micheli et al. | |
| 2009/0229470 | A1 | 9/2009 | Dorfmueller | |

FOREIGN PATENT DOCUMENTS

| | | | | |
|---|---|---|---|---|
| GB | 520367 | A * | 4/1940 | B05B 7/08 |
| GB | 2468196 | | 9/2010 | |
| GB | 2469587 | | 10/2010 | |

* cited by examiner

SPRAY GUN

CROSS REFERENCE TO RELATED APPLICATIONS

The present application claims priority to United Kingdom Patent Application Number 1110336.3 filed on Jun. 17, 2011, currently pending. The present application further claims priority to United Kingdom Patent Application Number 1115249.3 filed on Sep. 2, 2011.

BACKGROUND OF THE INVENTION

1. Field of the Invention

The present invention relates to a spray gun, particularly though not exclusively for spraying paint.

2. Description of Related Art

In this specification the term "spray liquid" is used to refer to paint or other liquid to be sprayed.

Generally spray guns are of two types, (i.) those operated by pumping the spray liquid to a nozzle whence it sprays under momentum imparted by being pumped through the nozzle and (ii.) those operated by blowing gas—usually air—past a nozzle, the air drawing the spray liquid from the nozzle and imparting momentum to it. Flow of paint can be regulated with a needle extending into the nozzle. The spray liquid may enter the nozzle at atmospheric or elevated pressure. This type of spray gun is referred to here as an "air spray gun". Air spray guns themselves are of two further types, those operating at conventional compressed air pressure and those operating at low pressure, but with high volume flow. These are known as HVLP spray guns. The invention relates to BOTH types of air spray gun. Air spray guns can be assisted by pumping of spray liquid to them.

Typically an air spray gun comprises:

- an air flow passage in the gun;
- a spray liquid nozzle mounted in the air flow passage and having an orifice for spray liquid to flow from, the orifice being on the downstream side of the spray liquid nozzle with respect to both air and spray liquid flow;
- a needle extending from upstream into the spray liquid nozzle for regulating its orifice and flow of the spray liquid;
- a spray liquid flow passage to the spray liquid nozzle, with the needle extending in the spray liquid flow passage;
- a flow-passage/needle seal at a position along the needle spaced from the spray liquid nozzle;
- a trigger mechanism connected to the needle to regulate its position;
- an air cap defining with the spray liquid nozzle:
  - a convergent air flow region immediately upstream of the spray liquid orifice,
  - a central opening from which spray liquid entraining air flows and
  - at least one pair of opposed horns having spray patterning bores with orifices directed inwards for patterning the spray liquid containing air flow from the central opening and
- an air distributor upstream of the air cap for distributing air to the patterning bores.

This air spray gun is referred to as being "of the type defined."

In our British patents Nos 2,468,196 and 2,469,587 ("Our Earlier Patents"), we have described improvements in such air spray guns, particularly

- provision of front loading of the needle and
- provision of four air horns on the air cap as opposed to the more normal two, the four horns being set at 12 o'clock, 3 o'clock, 6 o'clock and 9 o'clock with respect to the normal orientation of the air spray gun, and adaptation of the air distributor to provide progressive changing of the spray pattern from the gun.

SUMMARY OF THE INVENTION

The object of the present invention is to further improve spray patterning.

According to the present invention there is provided an air spray gun of the type defined, wherein:

- the central opening in the air cap and/or the outer surface of the spray liquid nozzle, in its extent towards the central opening, and/or a central bore in the air distributor is formed, i.e. provided with formations, so as to bias air flow towards the pair of air horns or, where two pairs are provided, the one of the pair having patterning air directed to them.

In other words, means is provided for biasing air flow to and through the central opening in the air cap towards the pair of air horns or, where two pairs are provided, the one of the pair having patterning air directed to them.

Whilst it is envisaged that a single pair of rotationally adjustable air horns only, together with a fixed air distributor, may be provided, in the preferred embodiment described below two pairs are provided, as in Our Earlier Patents, that is with the air horns being rotationally fixed and the air distributor being rotationally adjustable. The rotational adjustment is provided for changing the shape and/or the orientation of the spray pattern.

Preferably the air cap formations are spreadings of the central bore, the spreadings being diametrically aligned with the the air horns. In the preferred embodiment, the spreadings are two sided cut-outs or nicks directed towards their air horns.

Preferably the spray liquid nozzle formations are external cutaways aligned or alignable with the the air horns. In the preferred embodiment, the external cutaways are flats in the external conical surface of the nozzle. The flats could be scallops.

Preferably the air distributor bore formations are spreadings alignable with the the air horns. In the preferred embodiment, these spreadings are local, curved enlargements of the diametrical dimension of the bore. They can give the bore an elliptical shape.

Preferably, the air distributor and the spray liquid nozzle are rotationally connected whereby the nozzle cutaways and the air-distributor, bore spreadings are aligned. In the preferred embodiment, this is achieved via grooves in the nozzle and spigots on the air distributor engaging in the grooves.

The spray gun of the preferred embodiment is an HVLP air spray gun.

Additionally the provision of a pronounced radius of curvature of the formations in the air cap biases the air flow towards the air horns. Preferably the radius of curvature is between a fourth and an eighth of that of the transverse dimension of the central opening in the direction between opposed air horns. The preferred radius of curvature is substantially one sixth of this dimension.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE INVENTION

Figure 1:
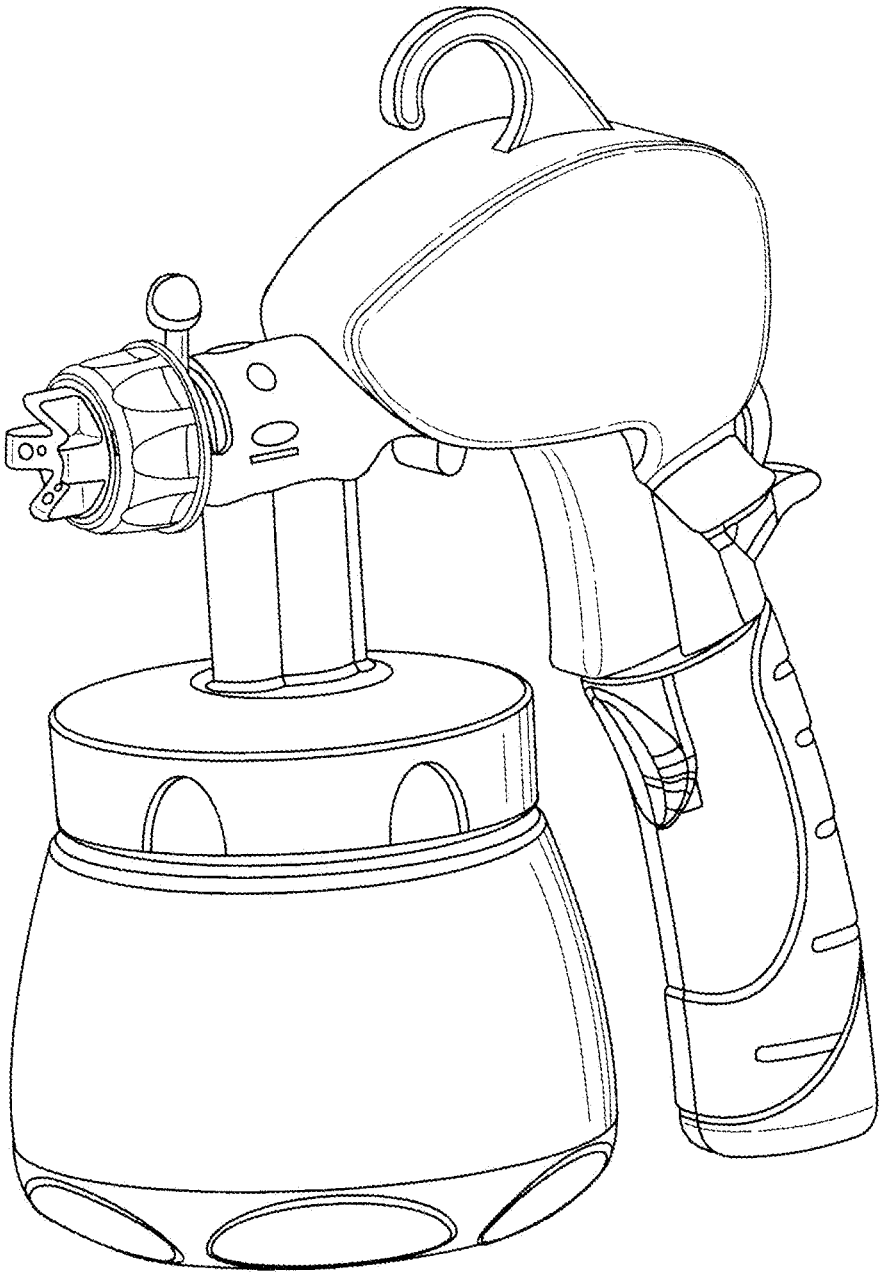
FIG. 1 is a perspective view of an air spray gun of the invention.
Figure 2:
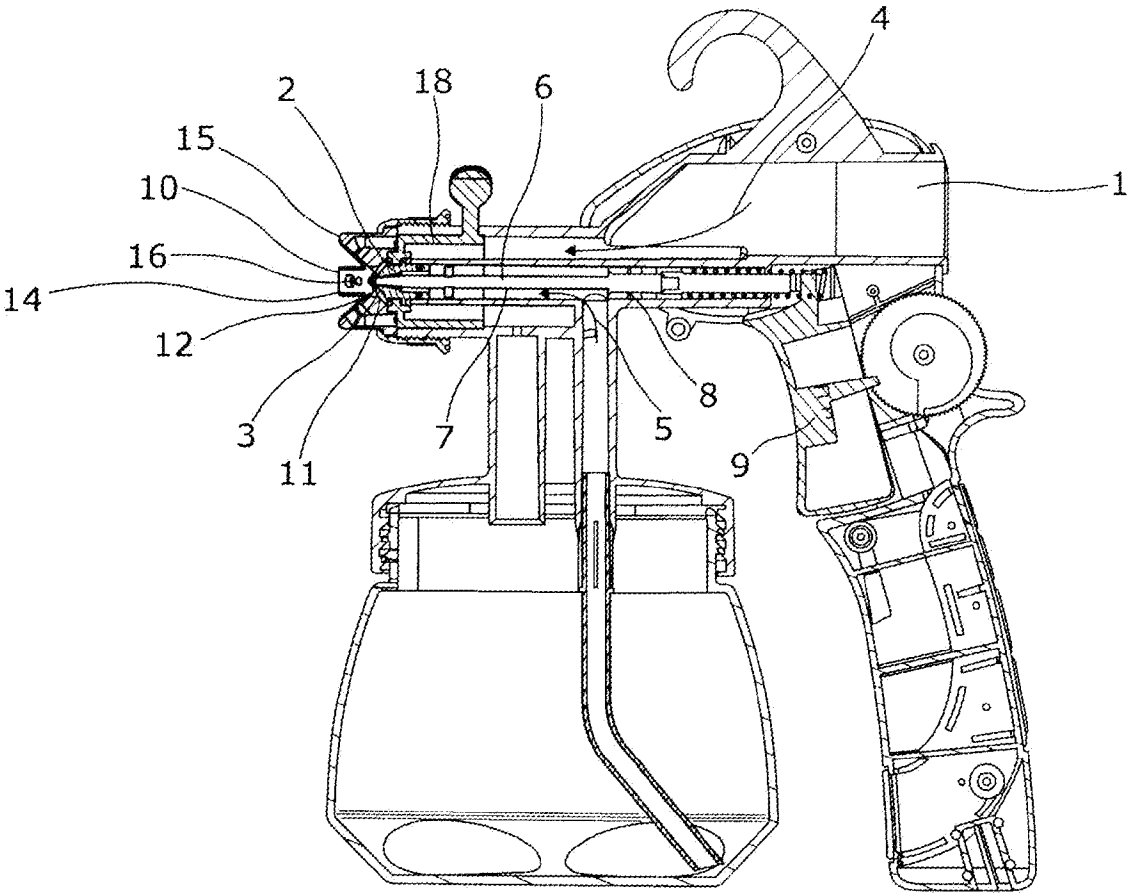
FIG. 2 is an elevational, cross-sectional view of the air gun of FIG. 1.
Figure 3:
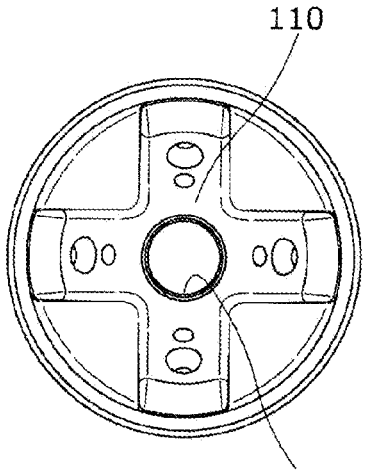
Fig. 3 Prior Art
FIG. 3 is a front view of the air cap of the air gun of Our Earlier Patents.
Figure 4:
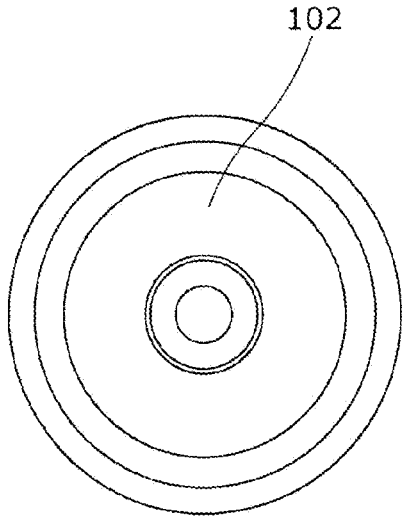
Fig. 4 Prior Art
FIG. 4 is a front view of the spray liquid nozzle of air gun of Our Earlier Patents.
Figure 5:
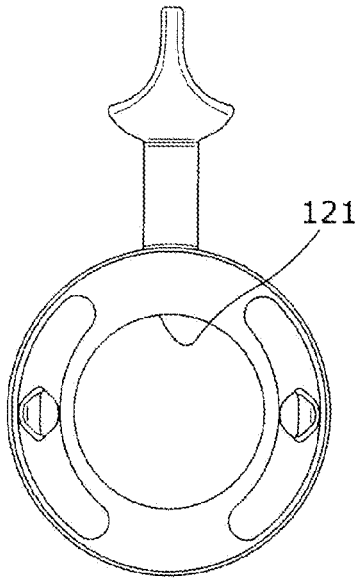
Fig. 5 Prior Art
FIG. 5 is a front view of the air distributor of air gun of Our Earlier Patents.
Figure 6:
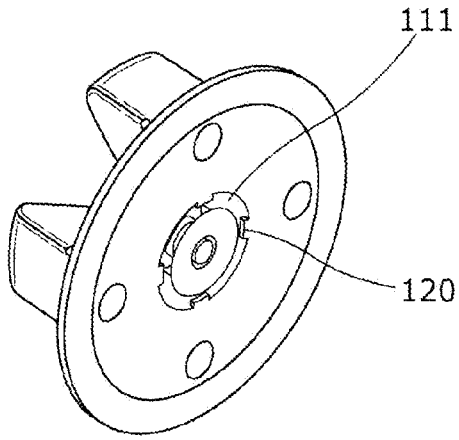
Fig. 6 Prior Art
FIG. 6 is a cross-sectional perspective view from behind the air cap and spray liquid nozzle of Our Earlier Patents.
Figure 7:
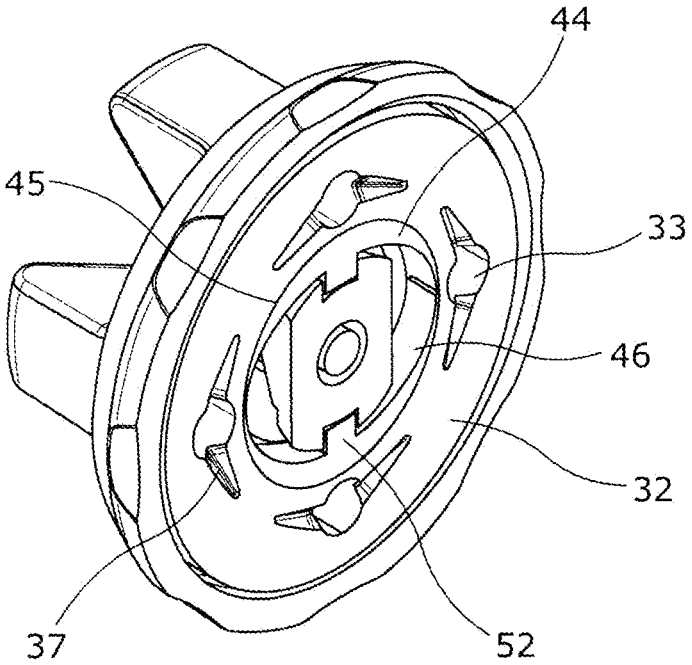
FIG. 7 is a similar cross-sectional view of the air cap and spray liquid nozzle of the air spray gun of FIG. 1, that is of the invention, the section being taken at the rear face of the air cap.
Figure 8:
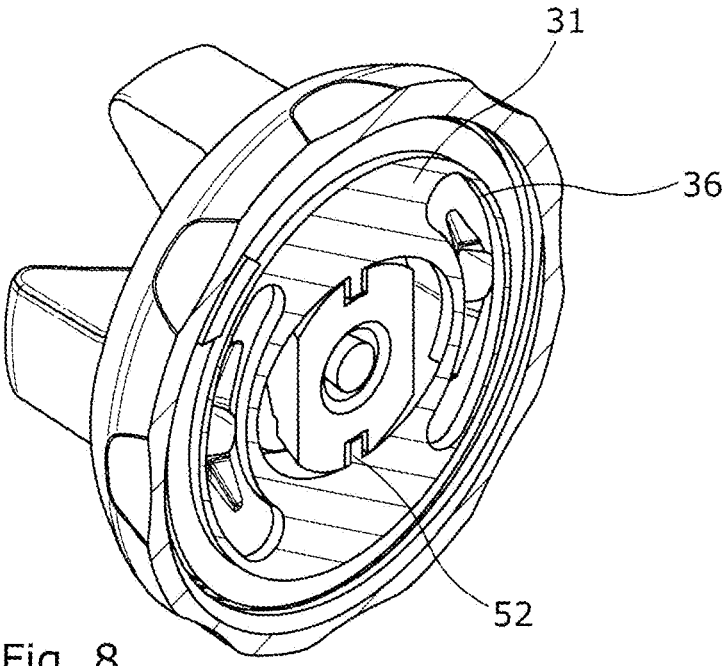
FIG. 8 is a similar cross-sectional view to that of FIG. 7, but taken slightly further back to show circumferential grooves in the air distributor.
Figure 9:
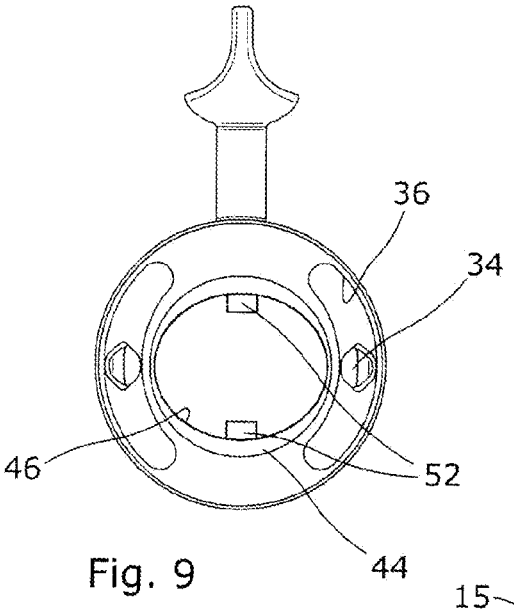
FIG. 9 is a front view, similar to FIG. 5, of the air distributor of the air spray gun of FIG. 1.
Figure 10:
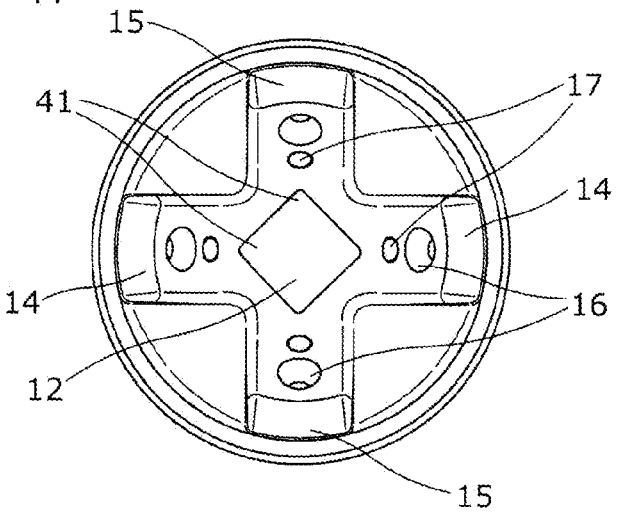
FIG. 10 is a front view, similar to FIG. 3, of the air cap of the air spray gun of FIG. 1.
Figure 11:
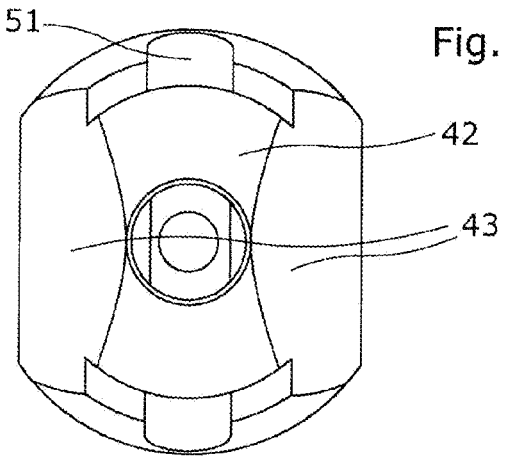
FIG. 11 is a front view, similar to FIG. 4, of the spray liquid nozzle of the air spray gun of FIG. 1.
Figure 12:
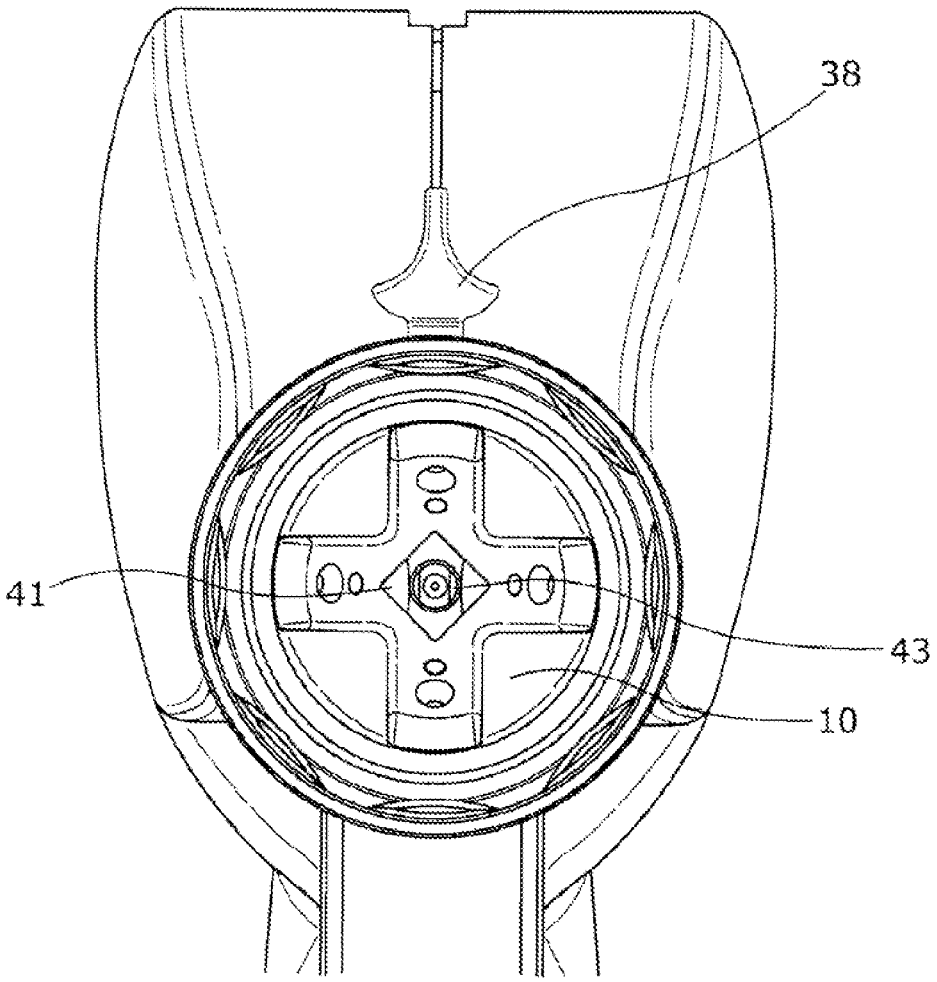
FIG. 12 is a scrap front view of the air spray gun of FIG. 1.
Figure 13:
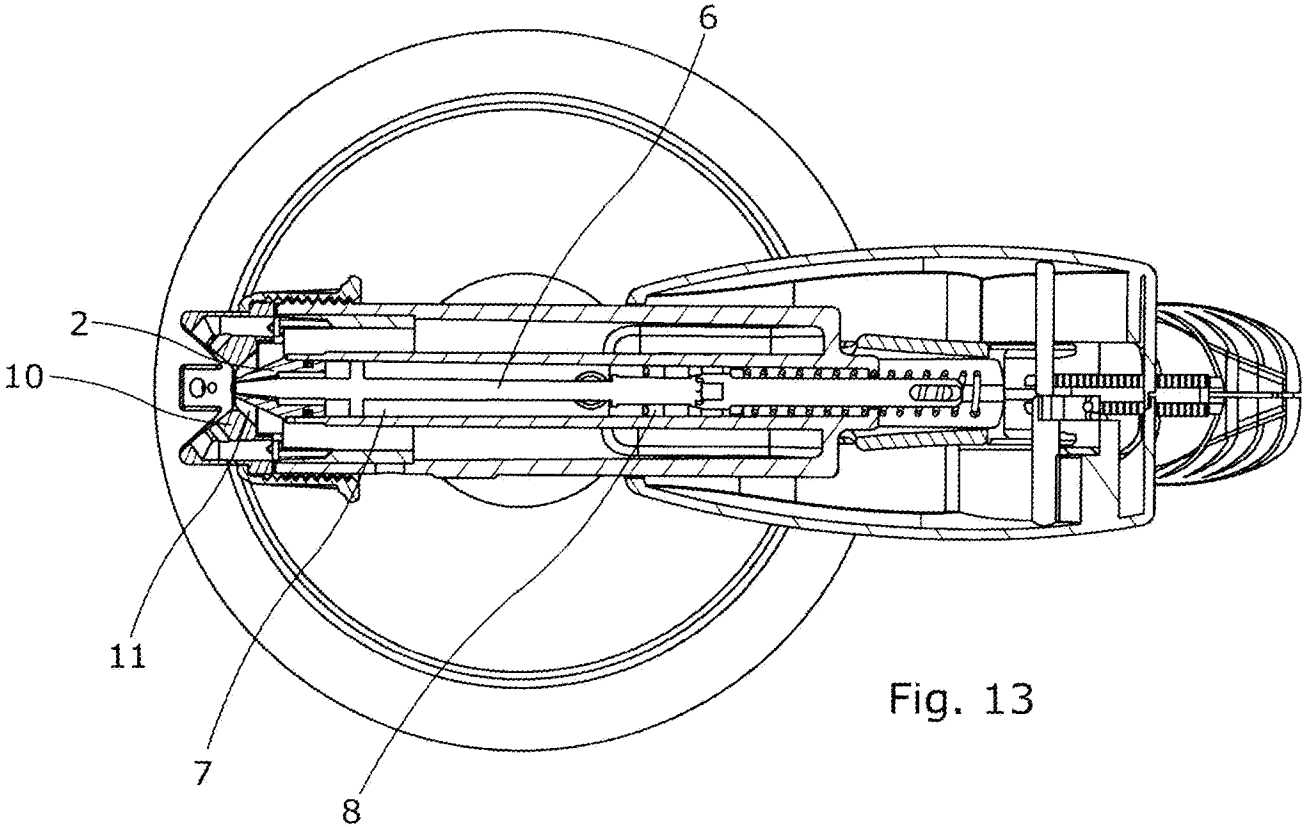
FIG. 13 is a plan cross-sectional view through the air cap of the air spray gun of FIG. 1.
Figure 14:
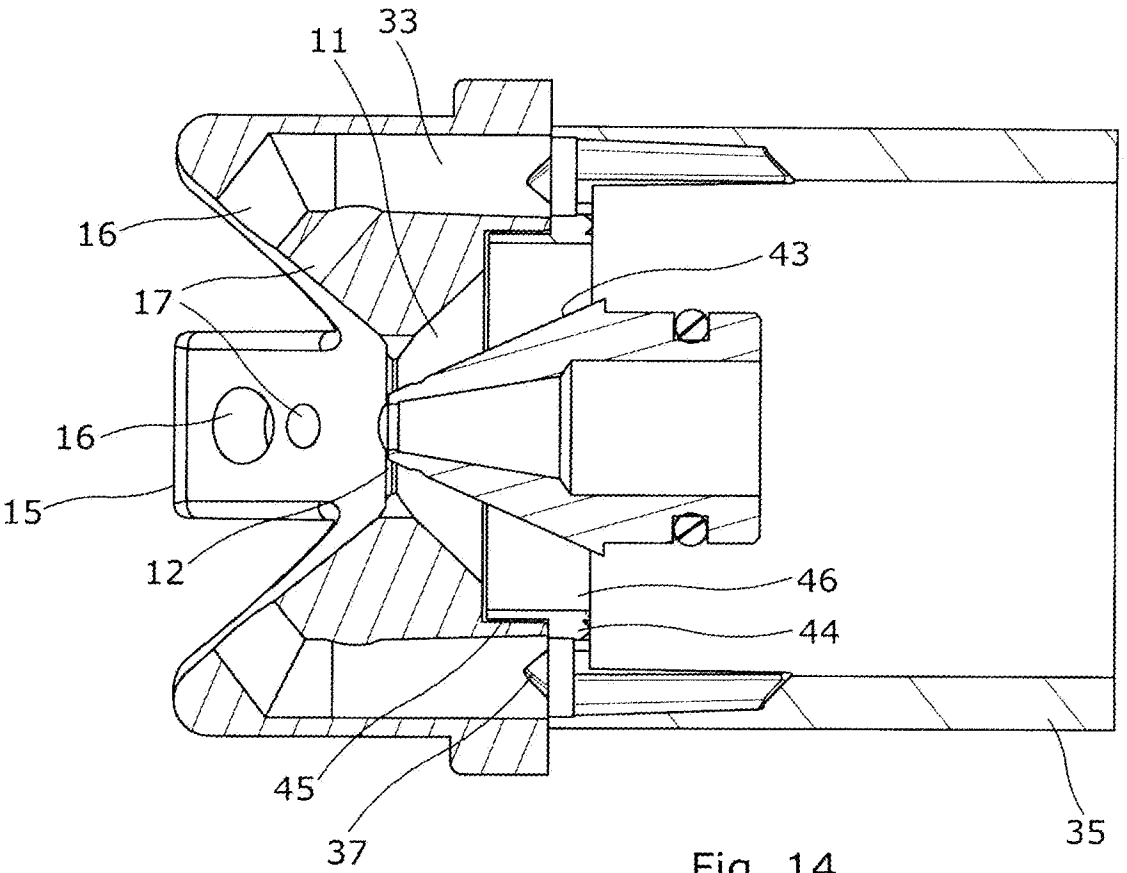
FIG. 14 is a scrap view as FIG. 13 of the air cap, nozzle and distributor only on a larger scale.
Figure 15:
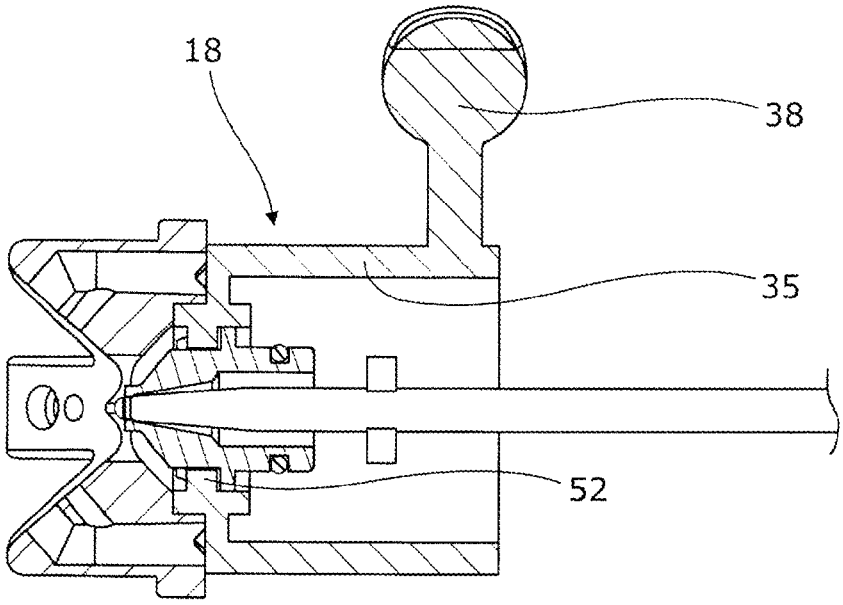
FIG. 15 is a similar view orthogonal to FIG. 14.
Figure 16:
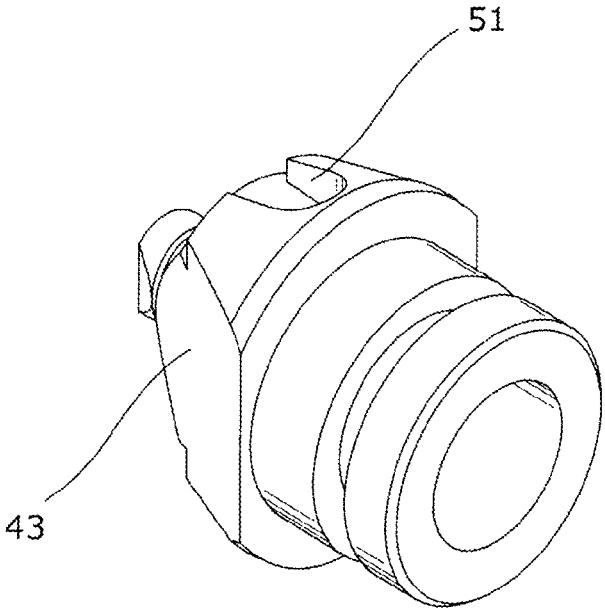
FIG. 16 is a rear perspective view of spray liquid nozzle of FIG. 11.

Referring to the drawings, FIG. 1 shows an air spray gun of the type defined. It is generic to Our Earlier Patents and the present invention, insofar as the parts of the present invention or at least their improvements are not visible in FIG. 1. Nor indeed are the parts identified in the above definition of type visible in FIG. 1. They are visible in FIG. 2, which is a sectional view of an air gun of the invention, as follows:

- an air flow passage 1 in the gun;
- a spray liquid nozzle 2 mounted in the air flow passage 1 and having an orifice 3 for spray liquid to flow from, the orifice being on the downstream side of the spray liquid nozzle with respect to both air and spray liquid flow 4,5;
- a needle 6 extending from upstream into the spray liquid nozzle 2 for regulating its orifice and flow of the spray liquid;
- a spray liquid flow passage 7 to the spray liquid nozzle, with the needle 6 extending in the spray liquid flow passage;
- a flow-passage/needle seal 8 at a position along the needle spaced from the spray liquid nozzle;
- a trigger mechanism 9 connected to the needle 6 to regulate its position;
- an air cap 10 defining with the spray liquid nozzle:
  - a convergent air flow region 11 immediately upstream of the spray liquid orifice 3,
  - a central opening 12 from which spray liquid entraining air flows and
  - a pair of opposed horns 14,14;15,15—four air horns, i.e. two pairs, being provided—having spray patterning bores 16,17 with orifices directed inwards for patterning the spray liquid containing air flow from the central opening 12 and
- an air distributor 18 upstream of the air cap 10 for distributing air to the patterning bores.

With reference to FIGS. 3 to 6, in the air spray gun of Our Earlier Patents, the central opening 112 of the air cap 110 is a circular bore and its convergent flow region 111 has four pips 120 extending inwards. The spray liquid nozzle 102 has a circularly conical front, which is in abutment with the pips 120, whereby the air cap and the nozzle are centered with respect to each other. The air distributor has a central bore 121, which also is a circular bore. Thus there is no feature of these components which biases the air flow in the central passageway towards or away from any one air horn or horns.

With reference to FIGS. 7 to 16 of the present invention, the purpose of the air distributor 18, both as in the air spray gun of Our Earlier Patents and in the present invention, is to direct air selectively to the air horns. For this purpose, it has a front flange 31, which abuts a rear face 32 of the air cap 10. The air cap 10 has through bores 33 for providing patterning air flow from upstream in the air flow passage 1 via ports 34 in a rear sleeve 35 of the air distributor 18. The front flange 31 has quarter-circular circumferential grooves 36 which opens into the through bores 33. The patterning bores 16,17 of the air horns 14, 15 open in the rear face of the air cap 10 at circumferentially extended orifices 37. These communicate with the grooves 36 to a greater or lesser extent according to the position of the distributor 18 set by its adjustment lug 38. The full details of this is explained in Our Earlier Patents and will not be elaborated on here. Suffice it to say only that one or other or both of the diametrically opposite pairs of air horns receives patterning air to an extent determined by the position of the adjustment lug 38.

In accordance with the present invention:

- the central opening 12 of the air cap 10 is radially biased towards the air horns 14, 15. In this preferred embodiment, the central opening is substantially square with the corners 41 of the square pointing towards the air horns 14, 15. The air cap 10 is not adjustable in this gun. These corners, or at least the ones provided with more air as described below, bias the air flow through the central opening and its entrained spray liquid towards the patterning flow from the horns, whereby the patterning effect is enhanced;
- the conical front 42 of the spray liquid nozzle 2 is provided with convergent flats 43 on diametrically opposite sides of the nozzle, allowing more air flow to the ones of the corners providing air to the active air horns;
- the air distributor 18 is provided with a forwards collar 44 extending forwards centrally of the front flange 31. The forwards collar 44 engages in the rear orifice 45 of the air cap 10. The bore 46 of the forwards collar 44 is non-circular, being biased towards its bores 33, to further enhance the air flow through the operative corners 41. The bore can be elliptical.

An additional feature is the provision of grooves 51 in the nozzle 2 between the flats 43 and pips 52 in the distributor bore 46. The pips 52 engage in the grooves 51, whereby the nozzle 2 is adjustably turned with the air distributor 18.

Figure 17:
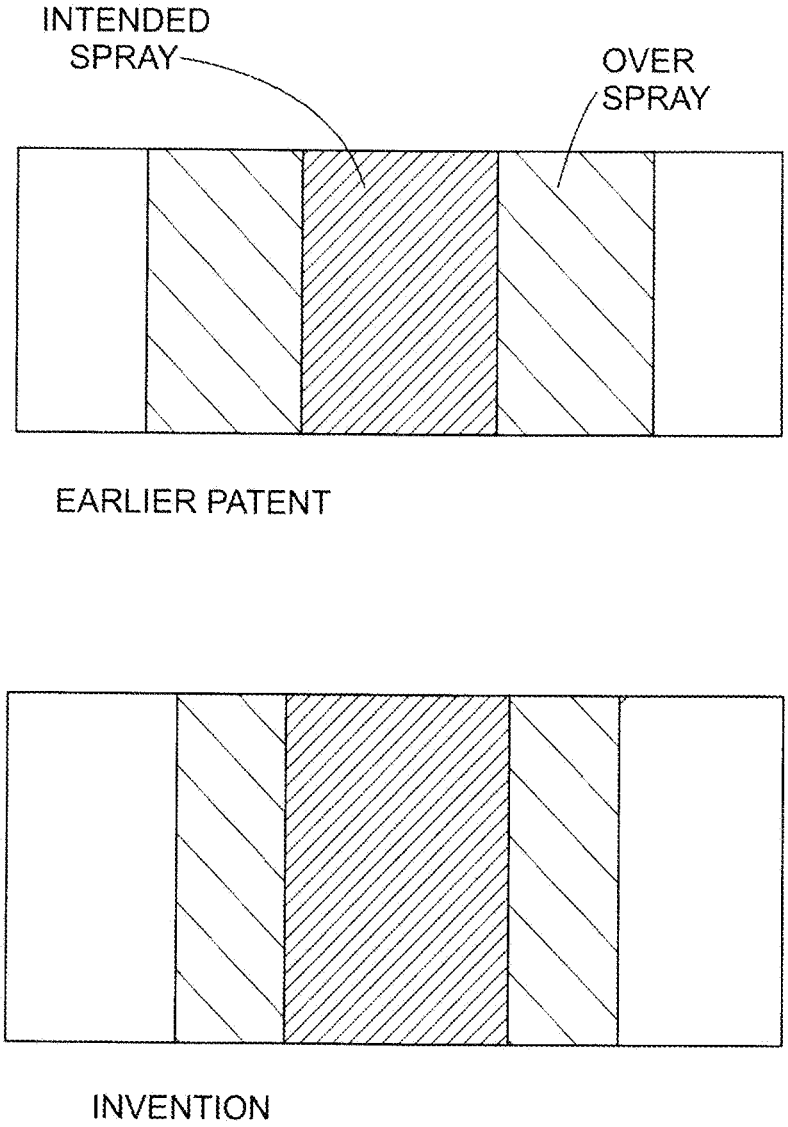
FIG. 17 is a diagram showing comparative spray distribution with the air guns of Our Earlier Patents and of the invention.

The result is the spray pattern is flattened to a greater extent than previously, but surprisingly with a more clearly defined edge and less over spray as shown in FIG. 17.

Figure 18:
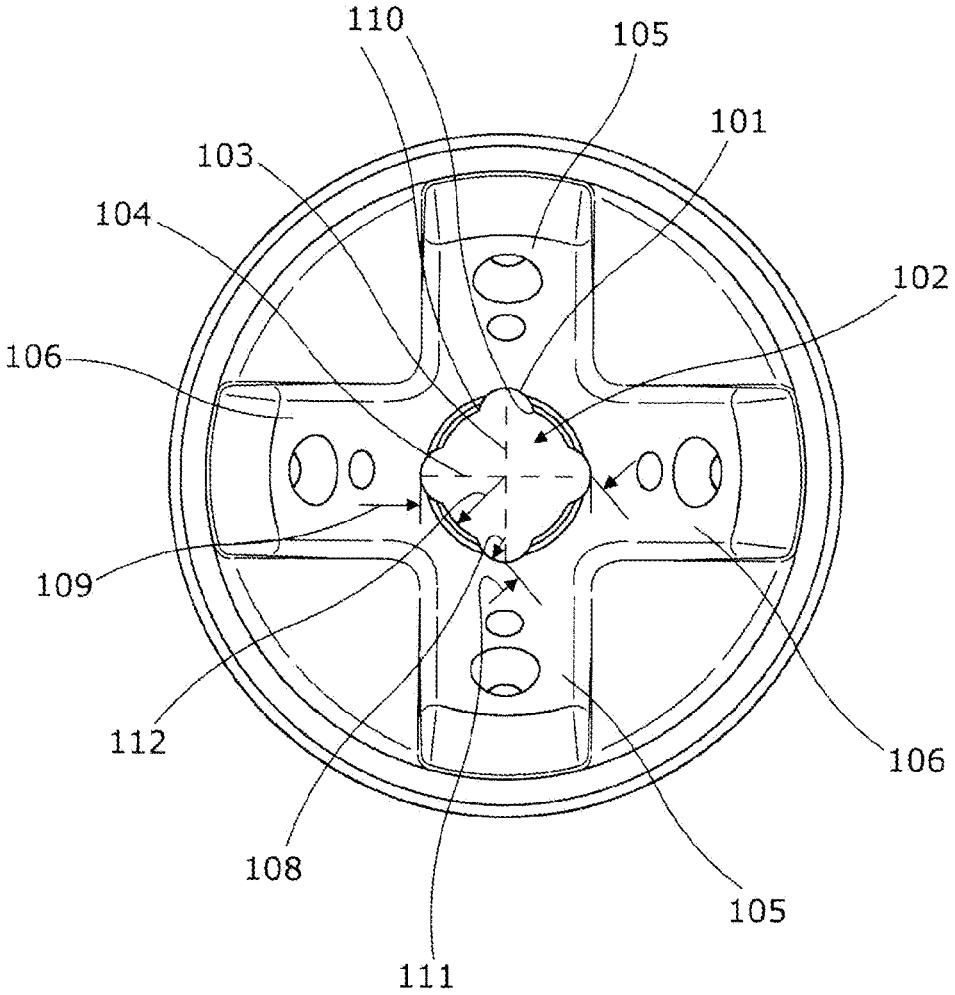
FIG. 18 is view similar to FIG. 10 of an air cap having an improved, pronouncedly-curved, central opening.

In the improvement of FIG. 18, the substantially-square, central opening of the air cap 10 is replaced by a compound curved shape providing pronounced curvature of the corners 101 of the opening 102 at the axes 103,104 between opposed air horns 105,106.

The corners 101 have a radius of curvature 108, typically 1.5 mm, and a dimension 109, typically 9 mm, on the axes which is the maximum transverse dimension of the opening. As shown, the radius of curvature is one sixth of that of the maximum transverse dimension. The sides of the opening do not extend tangential to the curved corners. Rather the corners curvature continues to points 110 spaced by approximately one third of the furthest separation 111 of the curvature of adjacent corners. The opening could be straight between the corners, but is preferably curved 112 with a radius typically 3.5 mm, centred at the centre of the opening and passing through the points 110.

We have found that this shape further improves paint spray patterning and discourages paint deposition on the air horns.

The invention claimed is:

1. A spray gun comprising:

an air flow passage in the gun;

a spray liquid nozzle mounted in the air flow passage and having an orifice for spray liquid to flow from, the orifice being on a downstream side of the spray liquid nozzle with respect to both an air flow and a spray liquid flow;

a needle extending from upstream into the spray liquid nozzle for regulating the orifice and flow of the spray liquid;

a spray liquid flow passage to the spray liquid nozzle, with the needle extending in the spray liquid flow passage;

a seal at a position along the needle spaced from the spray liquid nozzle;

a trigger mechanism connected to the needle to regulate the position of the needle;

an air cap, the air cap and spray liquid nozzle defining:

a convergent air flow region immediately upstream of the spray liquid orifice;

a central opening from which spray liquid entraining air flows; and at least one pair of opposed horns having spray patterning bores with orifices directed inwards for patterning the spray liquid containing air flow from the central opening; and an air distributor upstream of the air cap configured to distribute air to the patterning bores, wherein the central opening in the air cap is provided with formations radially biased towards the air horns, so as to bias the air flow towards the pair of air horns, and wherein the air distributor and spray liquid nozzle are connected and rotatable together around a longitudinal axis of the spray gun via an adjustment lug on the air distributor.

2. The spray gun of claim 1, wherein the air cap has two pairs of horns, rotationally fixed, and wherein the air distributor is rotationally adjustable.

3. The spray gun of claim 1, wherein the air cap formations are spreadings of the central opening, the spreadings being diametrically aligned with the air horns.

4. The spray gun of claim 3, wherein the spreadings are two sided cut-outs or nicks directed towards the air horns.

5. The spray gun of claim 1, wherein the spray gun is high velocity low pressure air spray gun.

6. The spray gun of claim 1, wherein the air cap formations have a pronounced radius of curvature biasing the air flow towards the air horns.

7. The spray gun of claim 6, wherein the radius of curvature is between a fourth and an eighth of the transverse dimension of the central opening in the direction between opposed air horns.

8. The spray gun of claim 7, wherein the radius of curvature is substantially one sixth of the dimension of the central opening.

9. The spray gun of claim 1, wherein the spray liquid nozzle includes grooves on external surfaces thereof and protrusions on the air distributor engage in the grooves to connect the air distributor and spray liquid nozzle.

10. A spray gun comprising:

an air flow passage in the gun;

a spray liquid nozzle mounted in the air flow passage and having an orifice for spray liquid to flow from, the orifice being on a downstream side of the spray liquid nozzle with respect to both an air flow and a spray liquid flow;

a needle extending from upstream into the spray liquid nozzle for regulating the orifice and flow of the spray liquid;

a spray liquid flow passage to the spray liquid nozzle, with the needle extending in the spray liquid flow passage;

a seal at a position along the needle spaced from the spray liquid nozzle;

a trigger mechanism connected to the needle to regulate the position of the needle;

an air cap, the air cap and spray liquid nozzle defining:

a convergent air flow region immediately upstream of the spray liquid orifice;

a central opening from which spray liquid entraining air flows; and at least one pair of opposed horns having spray patterning bores with orifices directed inwards for patterning the spray liquid containing air flow from the central opening; and an air distributor upstream of the air cap configured to distribute air to the patterning bores, wherein the central opening in the air cap is provided with formations radially biased towards the air horns, so as to bias the air flow towards the pair of air horns, wherein the air cap has a single pair of rotationally adjustable air horns, and wherein the air distributor is a fixed air distributor.

11. A spray gun comprising:

an air flow passage in the gun;

a spray liquid nozzle mounted in the air flow passage and having an orifice for spray liquid to flow from, the orifice being on the downstream side of the spray liquid nozzle with respect to both an air flow and a spray liquid flow;

a needle extending from upstream into the spray liquid nozzle for regulating the orifice and flow of the spray liquid;

a spray liquid flow passage to the spray liquid nozzle, with the needle extending in the spray liquid flow passage;

a seal at a position along the needle spaced from the spray liquid nozzle;

a trigger mechanism connected to the needle to regulate the position of the needle;

an air cap, the air cap and spray liquid nozzle defining:

a convergent air flow region immediately upstream of the spray liquid orifice;

a central opening from which spray liquid entraining air flows; and at least one pair of opposed horns having spray patterning bores with orifices directed inwards for patterning the spray liquid containing air flow from the central opening; and an air distributor upstream of the air cap for distributing air to the patterning bores, wherein an outer surface of the spray liquid nozzle has external cutaway formations to bias the air flow towards the pair of air horns, and wherein the air distributor and spray liquid nozzle are connected and rotatable together around a longitudinal axis of the spray gun via an adjustment lug on the air distributor.

12. The spray gun of claim 11, wherein the external cutaway formations are one of aligned and alignable with the air horns.

13. The spray gun of claim 12, wherein the external cutaways are flats in the external conical surface of the nozzle.

14. The spray gun of claim 11, wherein the spray liquid nozzle includes grooves on external surfaces thereof and protrusions on the air distributor engage in the grooves to connect the air distributor and spray liquid nozzle.

15. A spray gun comprising:

an air flow passage in the gun;

a spray liquid nozzle mounted in the air flow passage and having an orifice for spray liquid to flow from, the orifice being on the downstream side of the spray liquid nozzle with respect to both an air flow and a spray liquid flow;

a needle extending from upstream into the spray liquid nozzle for regulating the orifice and flow of the spray liquid;

a spray liquid flow passage to the spray liquid nozzle, with the needle extending in the spray liquid flow passage;

a seal at a position along the needle spaced from the spray liquid nozzle;

a trigger mechanism connected to the needle to regulate the position of the needle;

an air cap, the air cap and spray liquid nozzle defining:

a convergent air flow region immediately upstream of the spray liquid orifice;

a central opening from which spray liquid entraining air flows; and at least one pair of opposed horns having spray patterning bores with orifices directed inwards for patterning the spray liquid containing air flow from the central opening; and an air distributor upstream of the air cap for distributing air to the patterning bores, wherein the air distributor comprises a non-circular central bore having local curved formations being biased towards the air horns, so as to bias the air flow towards the pair of air horns, and wherein the air distributor and spray liquid nozzle are connected and rotatable together around a longitudinal axis of the spray gun via an adjustment lug on the air distributor.

16. The spray gun of claim 15, wherein the air distributor bore formations are spreadings alignable with the air horns.

17. The spray gun of claim 15, wherein the spreadings give the bore an elliptical shape.

18. The spray gun of claim 15, wherein the spray liquid nozzle includes grooves on external surfaces thereof and protrusions on the air distributor engage in the grooves to connect the air distributor and spray liquid nozzle.

* * * * *